US009416759B2

(12) United States Patent
Braun et al.

(10) Patent No.: US 9,416,759 B2
(45) Date of Patent: Aug. 16, 2016

(54) FUEL FEED DEVICE WITH INTEGRATED VERTICAL EJECTOR PUMP

(71) Applicant: Robert Bosch GmbH, Stuttgart (DE)

(72) Inventors: Hans-Peter Braun, Renfrizhausen (DE); Paul Mason, Dearborn, MI (US); David Toutant, Grosse Point Woods, MI (US)

(73) Assignee: Robert Bosch GmbH, Stuttgart (DE)

( * ) Notice: Subject to any disclaimer, the term of this patent is extended or adjusted under 35 U.S.C. 154(b) by 641 days.

(21) Appl. No.: 13/891,734

(22) Filed: May 10, 2013

(65) Prior Publication Data

US 2013/0306168 A1 Nov. 21, 2013

Related U.S. Application Data

(60) Provisional application No. 61/647,889, filed on May 16, 2012.

(30) Foreign Application Priority Data

May 24, 2012 (DE) ..... 10 2012 208 768

(51) Int. Cl.

| | |
|---|---|
| ***F04B 23/08*** | (2006.01) |
| ***F02M 37/22*** | (2006.01) |
| ***F02M 37/02*** | (2006.01) |
| ***F02M 37/10*** | (2006.01) |

(52) U.S. Cl.

CPC ..... *F02M 37/22* (2013.01); *F02M 37/025* (2013.01); *F02M 37/106* (2013.01); *F02M 2037/225* (2013.01); *Y10T 137/794* (2015.04)

(58) Field of Classification Search

CPC ... B60K 15/06; F02M 37/106; F02M 37/103; F02M 37/22; F02M 37/025; F02M 2037/228; Y10T 137/794

USPC ..... 417/80, 83; 137/544, 571, 576, 590

See application file for complete search history.

(56) References Cited

U.S. PATENT DOCUMENTS

| | | | | |
|---|---|---|---|---|
| 5,070,849 | A * | 12/1991 | Rich | F02M 37/106 123/509 |
| 5,647,330 | A * | 7/1997 | Sawert | B01D 35/26 123/509 |
| 6,109,299 | A * | 8/2000 | Hashimoto | B60K 15/077 123/514 |
| 7,485,219 | B2 * | 2/2009 | Urbahn | B01D 35/0276 210/167.01 |
| 7,964,096 | B2 * | 6/2011 | Kimisawa | F02M 37/025 123/509 |
| 2003/0127075 | A1 * | 7/2003 | Braun | B01D 35/0276 123/510 |
| 2004/0177886 | A1 * | 9/2004 | Nagata | F02M 37/025 137/571 |
| 2008/0127948 | A1 | 6/2008 | Braun et al. | |
| 2012/0018019 | A1 | 1/2012 | Martin et al. | |

FOREIGN PATENT DOCUMENTS

| | | |
|---|---|---|
| DE | 102004021919 | 12/2005 |
| DE | 102009002299 | 10/2010 |

* cited by examiner

*Primary Examiner* — Charles Freay

(74) *Attorney, Agent, or Firm* — Michael Best & Friedrich LLP

(57) ABSTRACT

A fuel feed device (1) for a fuel tank (3) is presented. The fuel feed device (1) has a filter (9) with a filter housing (11). The fuel feed device (1) furthermore has a second ejector pump (21) with a second nozzle (23) and a second mixing tube (25). The second mixing tube (25) is arranged perpendicularly to a base of the fuel tank (3). The second ejector pump (21) is at least partially integrated into the filter housing (11).

10 Claims, 7 Drawing Sheets

FUEL FEED DEVICE WITH INTEGRATED VERTICAL EJECTOR PUMP

BACKGROUND OF THE INVENTION

Fuel feed modules are used in fuel tanks to feed fuels such as diesel or petrol from a fuel tank to a combustion engine, in particular to an internal combustion engine. For this purpose, a fuel feed module can have a reservoir pot, in which fuel stands ready and is then pumped to the combustion engine by an electric fuel pump, for example. Here, the reservoir pot is filled by means of an ejector pump. Fuel feed modules of this kind can be produced economically and efficiently.

In the case of saddle tanks, the fuel feed module can be arranged on the right-hand side of the saddle in the direction of travel, for example. The fuel is pumped into the fuel feed module both from the right-hand and from the left-hand side of the saddle. For this purpose, an intake line is provided on the left-hand side of the saddle, said line being connected to a, possibly additional, ejector pump in the fuel feed module. However, the production and assembly of this ejector pump can be associated with high costs and a large amount of effort.

SUMMARY OF THE INVENTION

There can therefore be a need for a fuel feed device which can be produced and assembled in an economical and uncomplicated manner and is suitable, in particular, for use in a saddle tank.

In the text which follows, features, details and possible advantages of a device according to embodiments of the invention are discussed in detail.

According to a first aspect of the invention, a fuel feed device for a fuel tank is presented. The fuel feed device has a filter with a filter housing. It furthermore has a second ejector pump with a nozzle and a mixing tube. The mixing tube of the second ejector pump is arranged substantially perpendicularly to the reservoir pot base. The second ejector pump is at least partially integrated into the filter housing.

In other words, the concept of the present invention is based on integrating the second ejector pump, which can be connected to a left-hand saddle tank half, into the already existing components of the fuel feed device. This can be accomplished, for example, by parts of the second ejector pump, e.g. the mixing tube, being formed in one piece with the filter housing. Other parts of the fuel feed device, such as the filter cap, can furthermore act as part of the second ejector pump. For example, the filter cap can cover the nozzle of the second ejector pump.

Thanks to the integration of the second ejector pump into existing components of the fuel feed device, it is possible to save on production costs. Moreover, it is thereby possible to avoid additional expenditure of time in the assembly of various separately embodied components.

The fuel feed device can be used in fuel tanks and, in particular, in saddle tanks of motor vehicles, for example. The second ejector pump is referred to as the second because, as explained below, another ejector pump can be present, this being referred to below as the first ejector pump. The second ejector pump can be used as a single ejector pump of a fuel feed device or, alternatively, can be installed in the fuel feed device in addition to an already existing first ejector pump.

The second ejector pump, also referred to as the second EP or vertical ejector pump, is used to fill the reservoir pot with fuel from the left-hand and the right-hand or only from the left-hand side of the saddle. In particular, the second EP can be embodied in such a way that the fuel passes through the second EP from the top down.

The nozzle and the mixing tube of the second EP are referred to as the second nozzle and the second mixing tube. The mixing tubes can also be referred to as mixing chambers. The second mixing tube is arranged substantially perpendicularly to a horizontal, e.g. to the base of the fuel tank. This means that the mixing tube slopes by a maximum of 30°, preferably by a maximum of 10°, and in particular by 0°, to the vertical.

The second EP can furthermore be connected to an inlet line, through which the working medium, fuel, e.g. from an electric fuel pump (EFP), is supplied to the nozzle. From the inlet line, also referred to as the working line, the fuel enters the nozzle and passes through a small opening in the nozzle into the mixing tube. A pressure drop occurs in the mixing tube, as a result of which the intake fluid, namely fuel, is drawn in from the left-hand saddle tank half, via an intake line, or from the right-hand saddle tank half, via a bottom valve.

The filter can be a fuel filter with a filter housing and a filter cap. The filter and the second EP can form a module which optionally has an electric fuel pump and a first EP in addition. This module can be arranged in a reservoir pot or, alternatively, can be connected to a tank flange by guide rods, for example. In this case, the second EP is at least partially integrated with the filter housing and with other components of the fuel feed device. That is to say, the second EP is formed in one piece with said components and, in particular, with the filter housing, with the aid of an injection molding process, for example. For example, the mixing tube of the second EP can be injection molded together with the filter housing. As an alternative, parts of the second mixing tube or fastening components for the second mixing tube can be formed in one piece with the filter housing. In particular, the second EP can be integrated into the following existing components of the fuel feed device: electric fuel pump, filter housing, filter and filter cap.

According to an illustrative embodiment of the invention, the second nozzle, i.e. the nozzle of the second EP, is embodied separately from the filter housing. For example, the second nozzle can be injection molded in an additional method step and is not part of the filter housing or of the second mixing tube. In this way, it is possible, on the one hand, to produce the filter housing with parts of the second EP at low cost. On the other hand, the second nozzle can be machined very precisely through separate production. In particular, it is possible in this way to provide a second nozzle which has a diameter of a nozzle bore or opening of about Ø 0.3 mm. In the case where the nozzle is produced integrally with other components of the second EP, in contrast, the nozzle diameter would be about Ø 0.6 mm, leading to a sharp rise in the quantity of working fluid at high inlet pressures, which in turn would mean an EFP with a higher delivery rate and a poorer efficiency. By reducing the diameter of the nozzle opening, it is thereby possible to dispense with additional throttling elements upstream of the second nozzle.

According to another illustrative embodiment of the invention, a filter element is provided in the second nozzle. The filter element can be overmolded filter fabric, for example. The filter element serves to protect the second nozzle and prevents blockages of the nozzle opening.

According to another illustrative embodiment of the invention, the filter has a filter cap. In this case, the second nozzle is arranged between the filter housing and the filter cap. The filter cap can close an upwardly open end of the second nozzle. In this way, the second EP is integrated into the components of the fuel feed device in such a way that the filter cap offers protection for the second ejector pump.

According to another illustrative embodiment of the invention, the second mixing tube is formed integrally, i.e. in one piece, for example, with the filter housing. This can be accomplished by means of an injection molding process, for example. As an option, the second nozzle can also be formed in one piece, with a nozzle diameter Ø of 0.6 mm for example, as part of the filter housing. As an alternative, the EP can also be fed via a return from a pressure regulator.

According to another illustrative embodiment of the invention, the fuel feed device has a starting pot, also referred to as an anti-siphon device, arranged below the mixing tube. The starting pot has an opening through which the second mixing tube extends into the starting pot. In this case, the starting pot is arranged in the reservoir pot in such a way as to speed up starting or run-up of the second EP. This is made possible by the fact that the starting pot makes available a permanent fuel volume for the second EP, in which the second mixing tube, for example, can be immersed. In addition, the starting pot can perform an anti-siphon function by preventing fuel from flowing out of the reservoir pot through the second mixing tube or through an intake line. In particular, the starting pot makes it possible to prevent fuel from flowing out of the reservoir pot into the left-hand saddle tank half.

Providing a starting pot in the fuel feed device may be expedient, in particular, when the fuel flow direction of the second EP is from the top down. The starting pot can be of cup-shaped design and open upward toward the rim of the reservoir pot, for example.

According to another illustrative embodiment of the invention, the fuel feed device has a first ejector pump having a first nozzle and a first mixing tube. In this case, the first mixing tube is arranged parallel to the base of the fuel tank. The starting pot is formed integrally or in one piece with the first ejector pump. The first ejector pump, also referred to as the first EP or horizontal ejector pump, can be used to fill the reservoir pot with fuel from the right-hand side of the saddle. The nozzle and the mixing tube of the first EP are referred to as the first nozzle and the first mixing tube. The first EP, like the second EP, can be connected to an inlet line.

According to another illustrative embodiment of the invention, the fuel feed device has a reservoir pot. In this case, the reservoir pot can be positioned as close as possible to the base of the fuel tank, on the right-hand side of the saddle in the direction of travel. The filter, the second EP, the first EP and, if appropriate, further components are arranged in the reservoir pot. In this case, the starting pot is formed integrally with the reservoir pot, in particular with the reservoir pot base.

In this context, the starting pot can be produced together with the first EP or with the reservoir pot in an injection molding process, for example, or can be clipped to the mixing tube of the second EP, for example, as a separate component. In this case, the starting pot can be arranged above the first mixing tube or on the reservoir pot base, for example.

According to another illustrative embodiment of the invention, the starting pot and the nozzle are formed integrally or in one piece with the second mixing tube. For example, the second mixing tube and the starting pot as well as the nozzle can be injection molded in one piece. In the case of integral embodiment of the second mixing tube with the starting pot, it may be expedient to produce this element separately. That is to say that, in the case of this embodiment, the second mixing tube is not or not fully integrated into the filter housing. However, the filter housing can provide fastening elements, enabling the component consisting of the second mixing tube and the starting pot to be clipped to the filter housing, for example. In this way, the complexity of the injection mold for the filter housing is reduced and the adaptability of the second EP to alternative customer specifications is simplified.

According to a second aspect of the invention, a production method for a fuel feed device described above is presented. The method has the following steps: provision of a filter with a filter housing; arrangement of a second ejector pump with a second nozzle and a second mixing tube on the filter in such a way that the second mixing tube is aligned perpendicularly to a base of a fuel tank; integration of the second ejector pump into the filter housing.

The steps of the method can be performed in different sequences. For example, the integration of the second ejector pump into the filter housing can take place before the second ejector pump is arranged in the reservoir pot. In this case, integration can take place in an injection molding process. Moreover, the method can have the following additional steps: provision of a reservoir pot with a reservoir pot base; arrangement of a first ejector pump with a first nozzle and a first mixing tube in the reservoir pot in such a way that the first mixing tube is aligned parallel to the reservoir pot base; arrangement of a second ejector pump in the reservoir pot in such a way that the second mixing tube is arranged perpendicularly to the reservoir pot base.

Further features and advantages of the present invention will become apparent to those skilled in the art from the following description of illustrative embodiments, which should not, however, be interpreted as restricting the invention, with reference to the attached drawings.

DETAILED DESCRIPTION

All the figures are merely schematic illustrations of devices according to the invention and of the components thereof in accordance with illustrative embodiments of the invention. Spacings and relative sizes, in particular, are not shown to scale in the figures. In the various figures, corresponding elements are provided with the same reference numbers.

Figure 1:
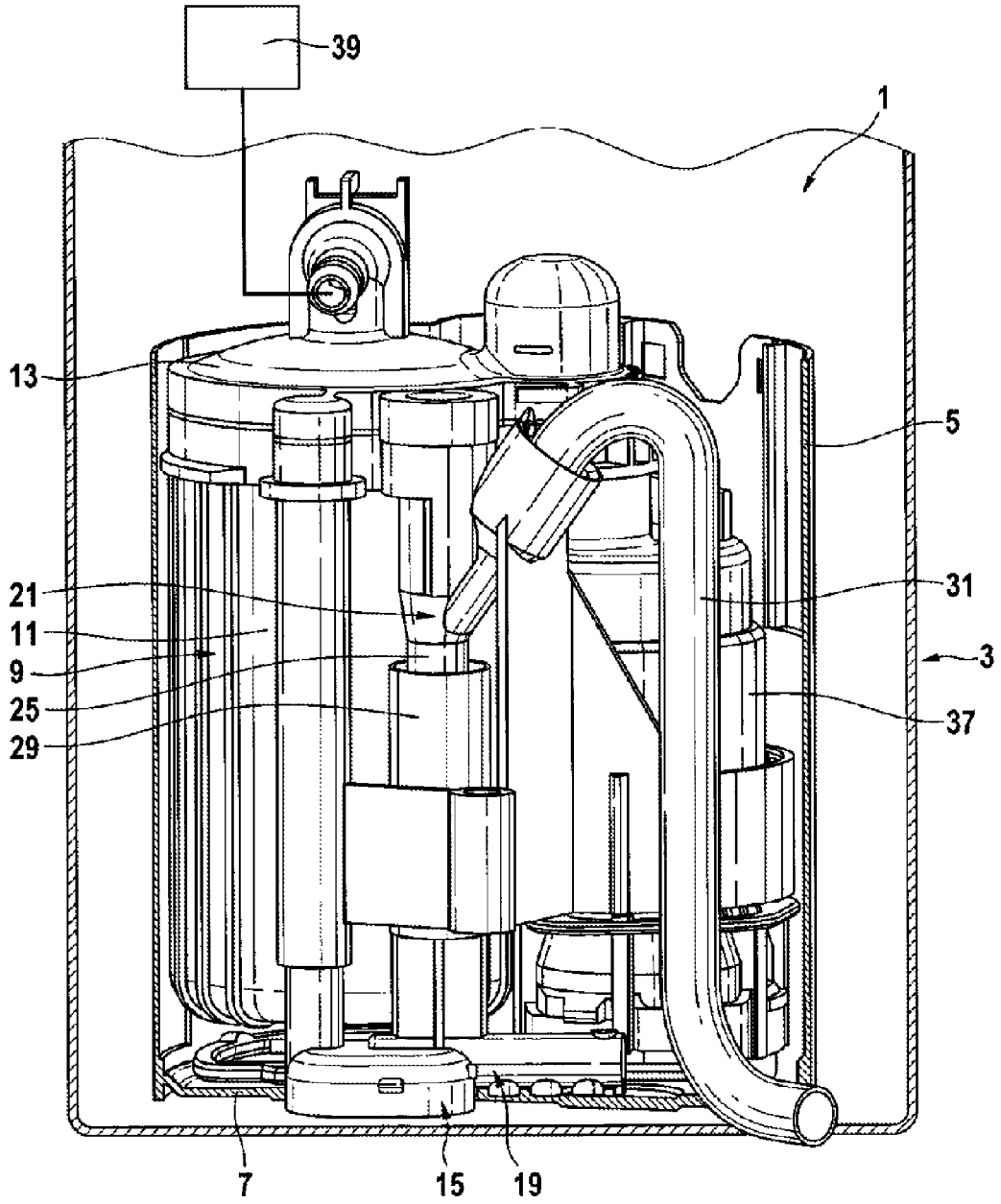
FIG. 1 shows a side view of a fuel feed device in accordance with one illustrative embodiment of the invention.

FIG. 1 shows a side view of a fuel feed device 1, which is arranged in a fuel tank 3. In particular, the fuel feed device 1 is arranged in a right-hand saddle tank half in the direction of travel. An intake line 31 connects a left-hand saddle tank half to the fuel feed device 1. In the fuel feed device 1, fuel is collected and fed to a combustion engine 39 by a feed unit, which is embodied as an electric fuel pump 37 in the illustrative embodiment.

Figure 3:
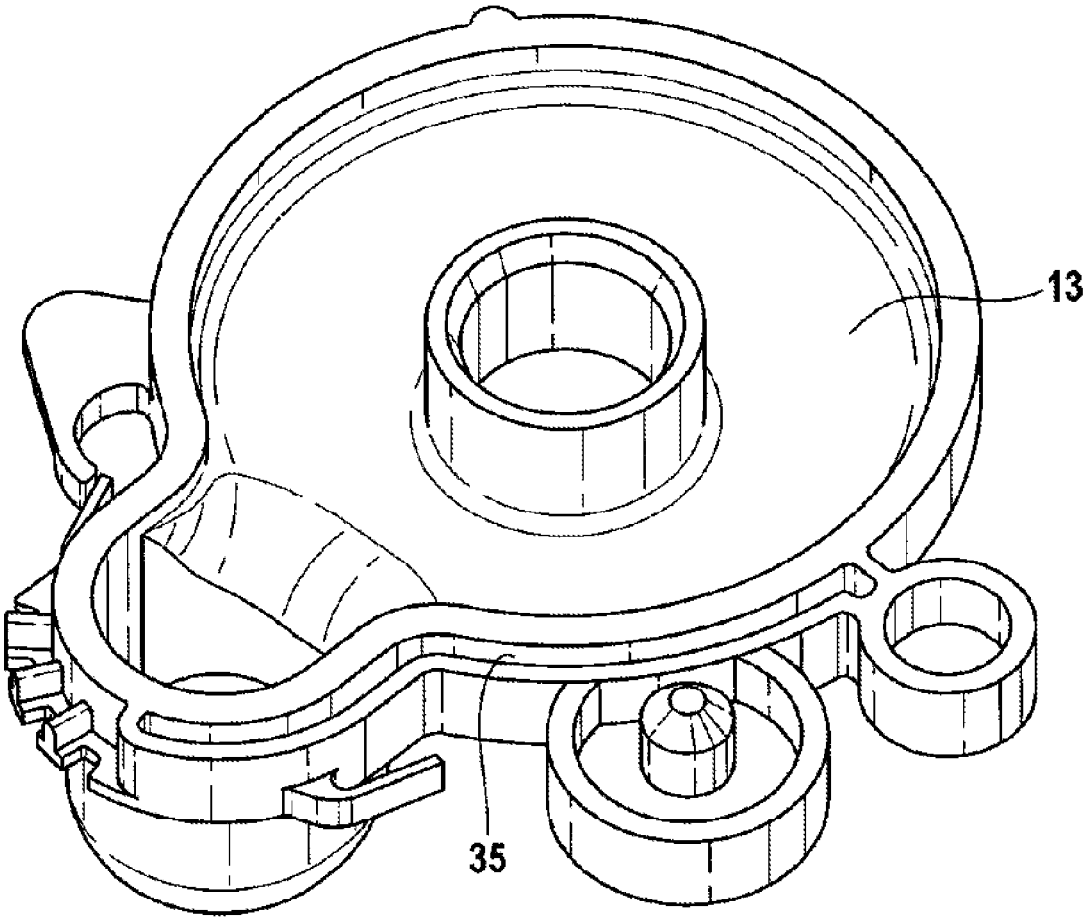
FIG. 3 shows a plan view of a filter cap.
Figure 4:
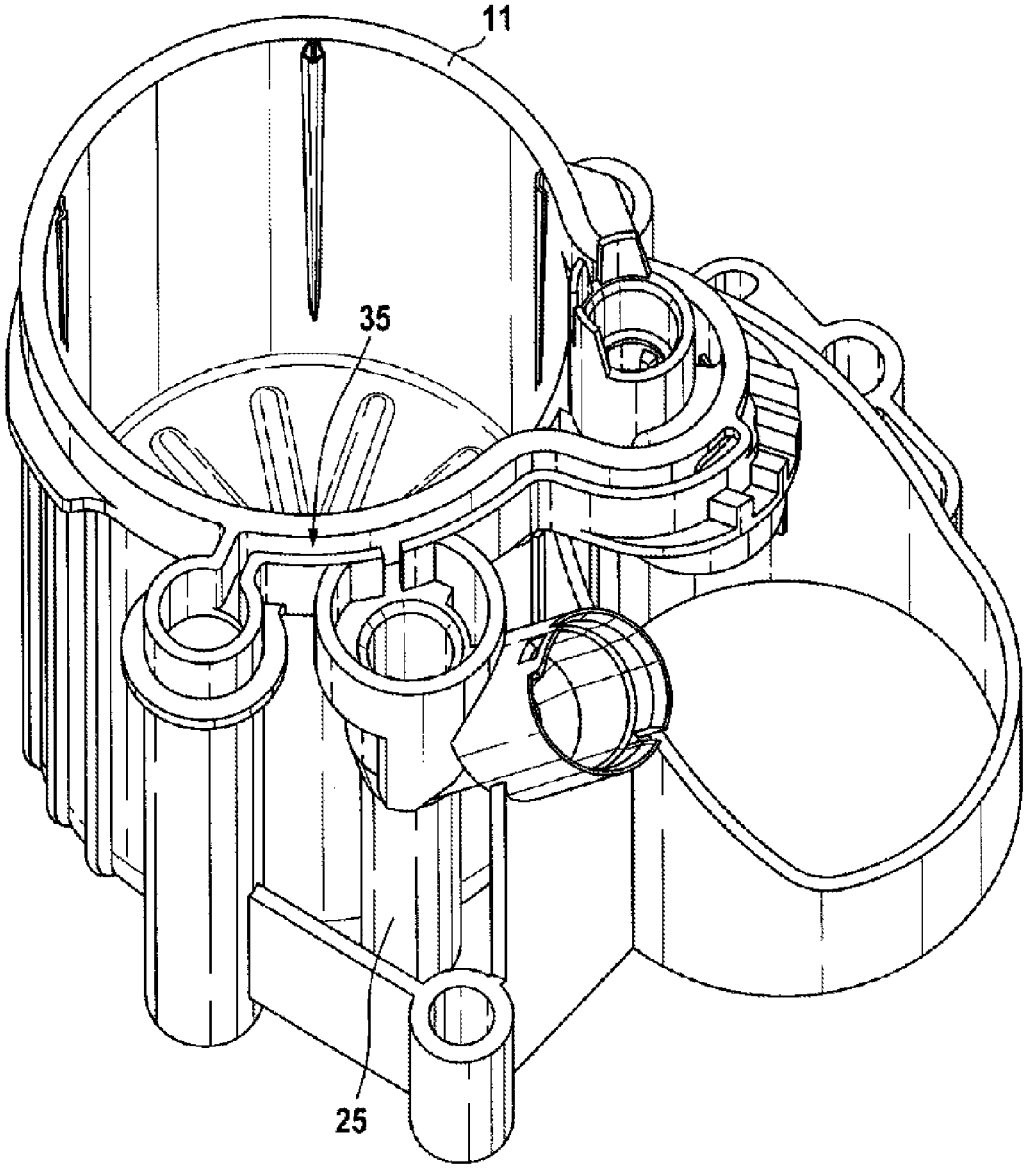
FIG. 4 shows a filter housing with an integrated second mixing tube.

The fuel feed device 1 has a reservoir pot 5 with a reservoir pot base 7. The electric fuel pump 37 can draw in fuel from the reservoir pot 5, e.g. via a preliminary filter, and supply it to the combustion engine 39 via a filter 9 and a delivery line. Some of the fuel drawn in by the electric fuel pump 37 can furthermore be introduced into another line. This other line can be referred to as an inlet line 35 and is illustrated in FIGS. 3 and 4, for example. The fuel carried in the inlet line 35 is used as the working fluid for a first ejector pump 15 and a second ejector pump 21. In this case, the inlet line 35 can be divided, as shown in FIG. 4, in order to provide a hydraulic connection to the first ejector pump 15, on the one hand, and to the second ejector pump 21, on the other hand. The inlet line 35 can furthermore run partially in the filter housing 11, as illustrated in FIG. 4, and partially in the filter cap 13, as shown in FIG. 3. If the ejector pumps 15, 21 are fed via the return from a pressure regulator, for example, the inlet line 35 can be closed toward the EFP 37.

The ejector pumps 15, 21 prevent the electric fuel pump 37 from emptying the reservoir pot 5 by filling the reservoir pot 5 with fuel from the fuel tank 3. In this arrangement, the first ejector pump 15 draws in fuel from the right-hand saddle tank half illustrated in FIG. 1 into the reservoir pot 5. In this case, it is embodied as a horizontal ejector pump and draws in fuel via a bottom valve, for example. The second ejector pump 21 draws fuel into the reservoir pot 5 from the left-hand saddle tank half via the intake line 31. In this case, it is embodied as a vertical ejector pump. In this case, the fuel flows vertically to the reservoir pot base 7, from the top down through the second ejector pump 21.

The abovementioned filter 9 has a filter housing 11 and a filter cap 13. The first ejector pump 15 has a first nozzle 17 and a first mixing tube 19 oriented parallel to the reservoir pot base 7. The second ejector pump 21 has a second nozzle 23 and a second mixing tube 25. It is shown in more detail in FIG. 2.

According to the invention, the second ejector pump 21 or parts of the second ejector pump 21 is/are integrated into the filter housing 11 and, if appropriate, into other components of the fuel feed device 1. In this way, it is possible to reduce costs and to simplify an assembly process for the fuel feed device 1.

In the illustrative embodiments in FIGS. 1 to 6 and 7, the second mixing tube 25 is formed integrally or in one piece with the filter housing 11. This is shown particularly clearly in FIG. 4, which shows the injection molded filter housing 11 in a perspective view.

Figure 2:
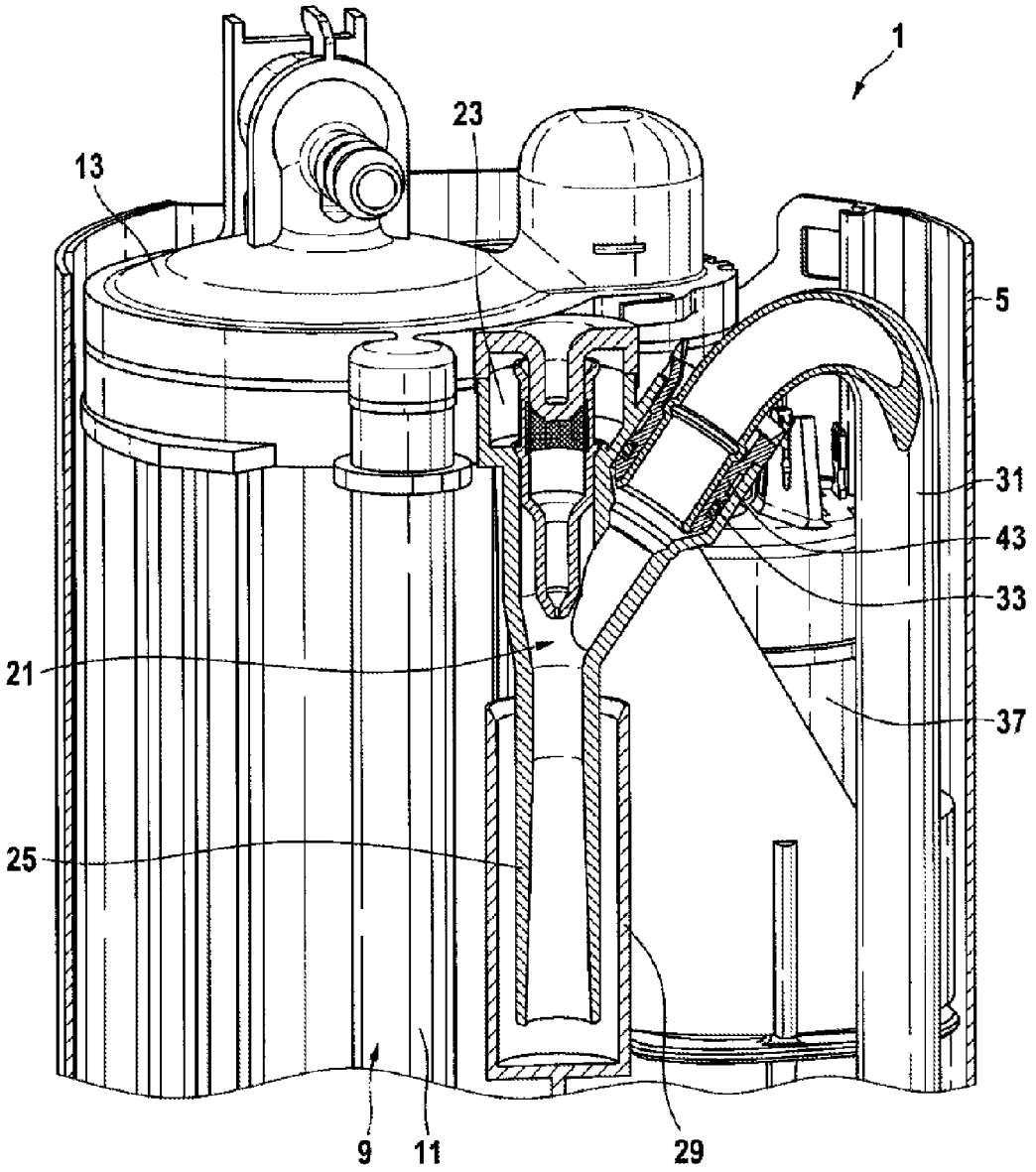
FIG. 2 shows a cross section through a second ejector pump, which is shown in FIG. 1.
Figure 6:
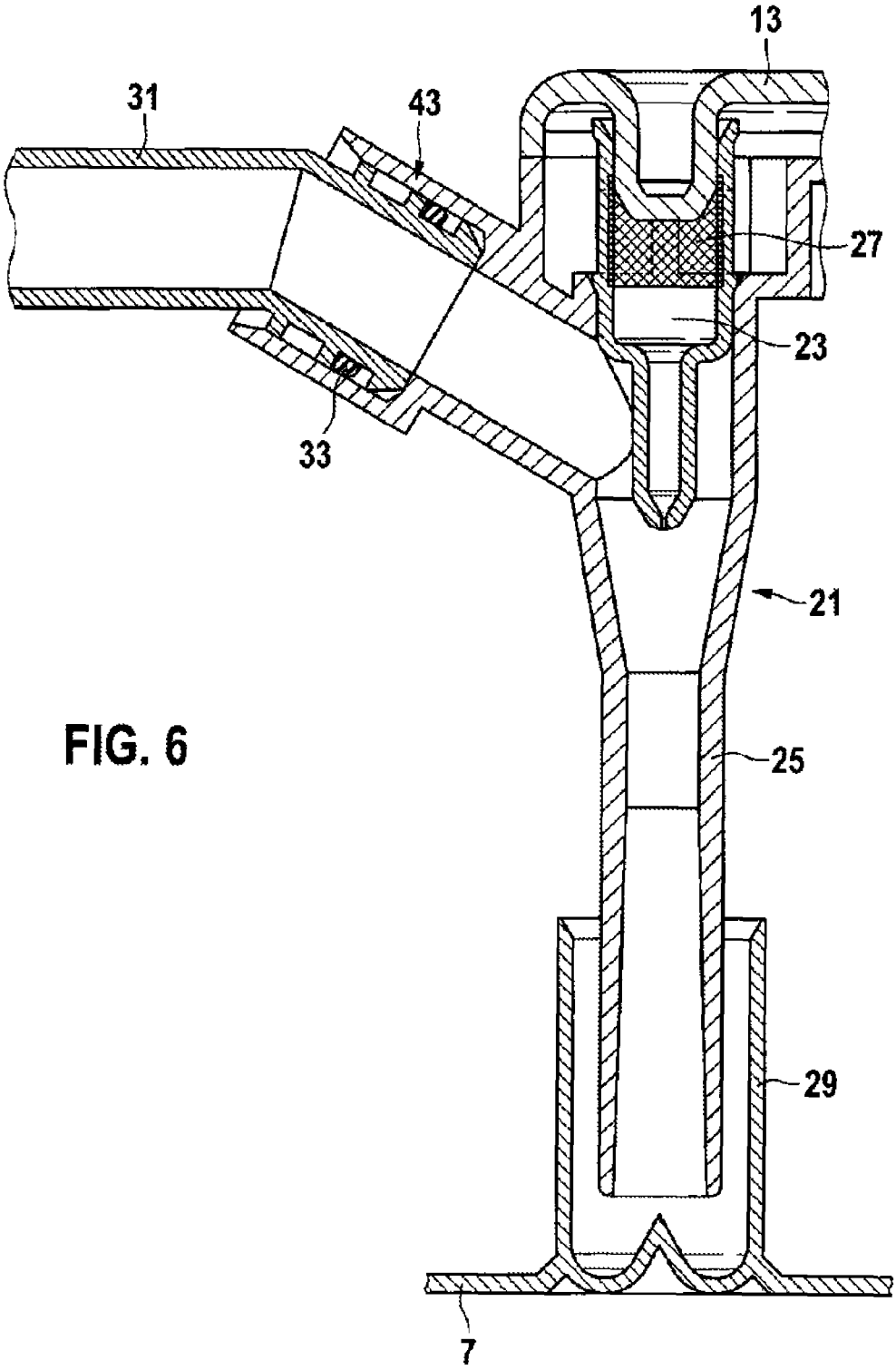
FIG. 6 shows a cross section through a second ejector pump with a starting pot integrated into the reservoir pot base.

In this case, the second nozzle 23 can be embodied as a separate component in order to allow more precise machining and hence a smaller nozzle opening. As an alternative, the second nozzle 23 can be formed in one piece with other components. The embodiment of the second nozzle as a separate component is illustrated in FIGS. 2 and 6, for example. In this case, the second nozzle 23 can be separately injection molded, for example. A filter element 27 can be provided in the second nozzle 23. As shown in FIG. 2, the second nozzle 23 is furthermore arranged between the filter cap 13 and the filter housing 11 and in this way is integrated into the filter housing 11.

The fuel feed device furthermore has a starting pot 29. The starting pot 29 makes available a permanent fuel volume, in which the second mixing tube 25 is immersed, and in this way allows rapid starting of the second ejector pump 21. It is furthermore of cup-shaped design, for example, and prevents an unwanted outflow of fuel from the reservoir pot 5.

In the illustrative embodiment in FIG. 1, the starting pot 29 is formed integrally with the first ejector pump 15. In particular, a base of the starting pot 29 corresponds here to an upper region of the first mixing tube 19, for example.

In the illustrative embodiment in FIG. 6, the starting pot 29 is formed in one piece with the reservoir pot 5. In particular, the starting pot 29 is integrated into the reservoir pot base 7.

Figure 5:
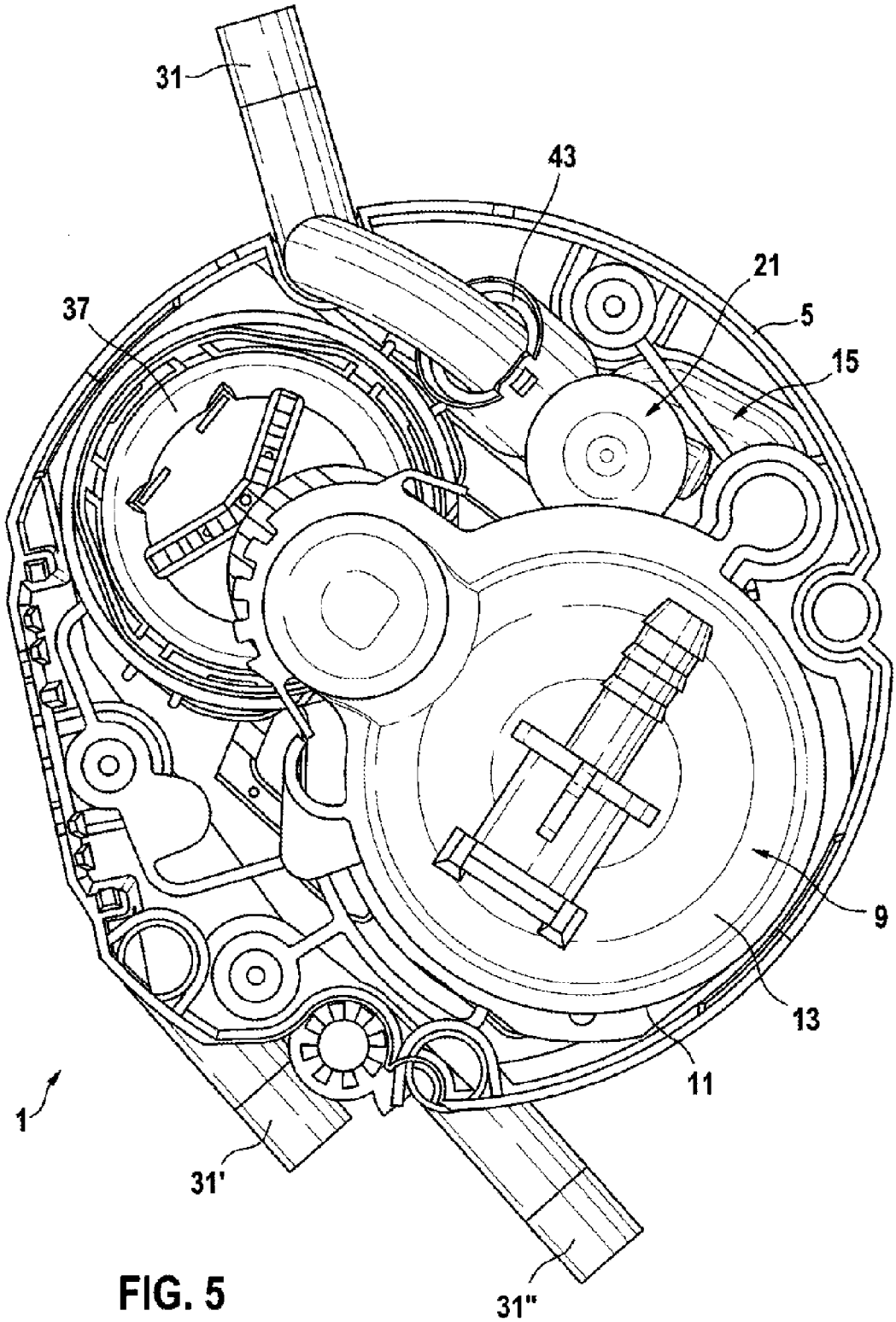
FIG. 5 shows a plan view of a fuel feed device with alternative positions for an intake line.

As an alternative, the connection 43 can be embodied as a separate clamping element, as shown in FIG. 2. O-rings 33 can furthermore be provided between the intake line 31 and the connection 43 for the purpose of sealing the line. Various possibilities for the positioning of intake lines 31, 31' and 31" are shown in FIG. 5.

Figure 7:
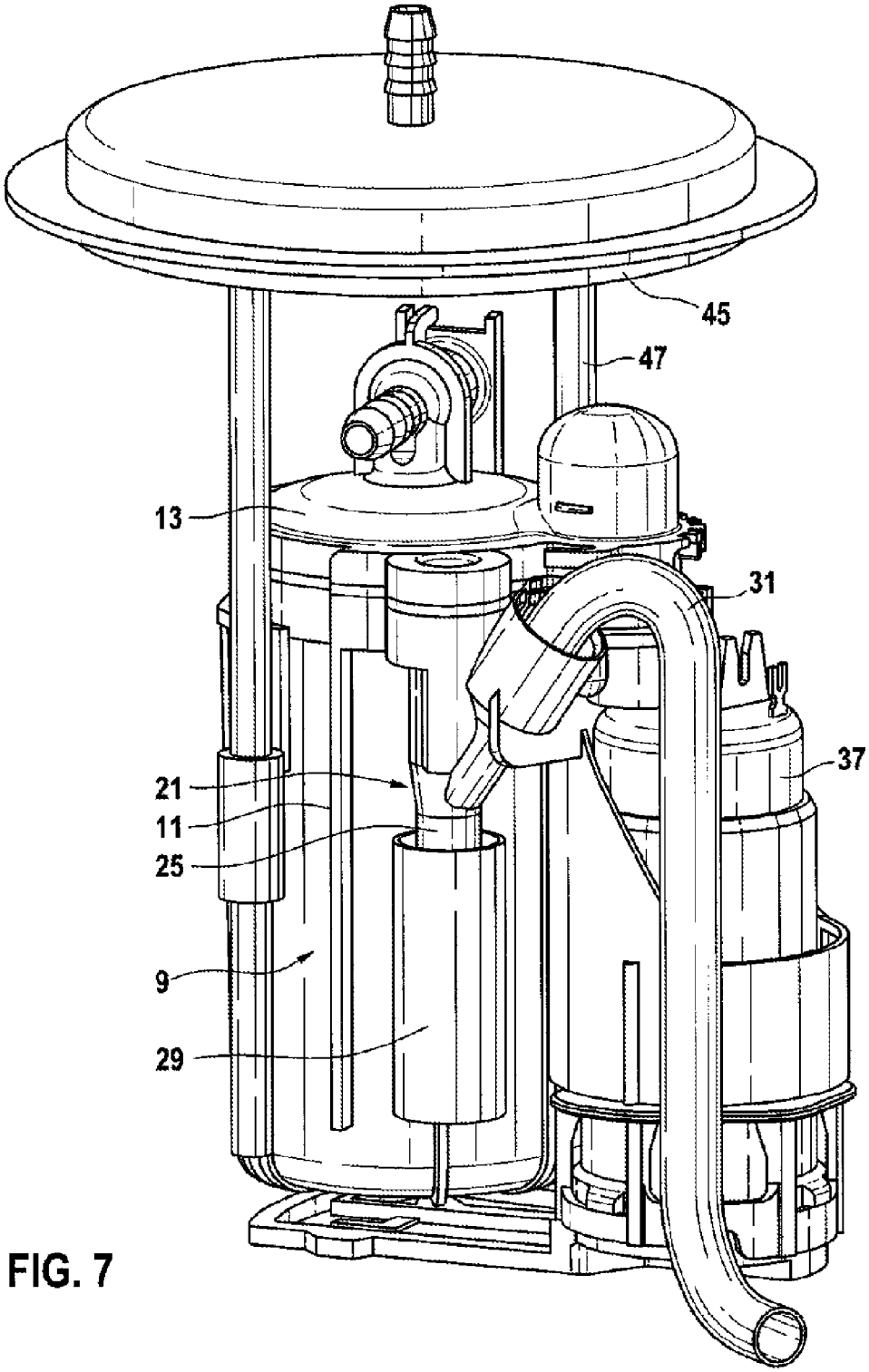
FIG. 7 shows a side view of a fuel feed device in accordance with another illustrative embodiment of the invention.

FIG. 7 shows an alternative embodiment of the fuel feed device 1 without a reservoir pot. In this case, the module comprising the filter 9, the second ejector pump 21 and the electric fuel pump 37 is arranged on a flange 45 of a fuel tank 3. The module is connected to the flange 45 by guide rods 47 and can be pressed against the base of the fuel tank 3, if appropriate by means of spring elements.

In conclusion, it is noted that expressions such as "having" or similar are not intended to exclude the possibility of providing further elements or steps. It should furthermore be noted that "a" or "an" do not exclude more than one. Moreover, features described in connection with the various embodiments can be combined with one another in any desired manner. It is furthermore noted that the reference signs in the claims should not be interpreted as restricting the scope of the claims.

The invention claimed is:

1. A fuel feed device (1) for a fuel tank (3), the fuel feed device (1) comprising:
- a fuel pump (37);
- a filter (9) with a filter housing (11);
- an ejector pump (21) with a nozzle (23) and a mixing tube (25);
- wherein the mixing tube (25) is arranged perpendicularly to a base of the fuel tank (3); and
- an inlet line (35) for conducting fuel from the fuel pump (37) to the nozzle (23) of the ejector pump (21);
- wherein the inlet line (35) is integrated in the filter housing (11); and
- wherein the mixing tube (25) and a connection (43) of the mixing tube (25) for connecting an intake line (31) is formed in one piece with the filter housing (11).

2. The fuel feed device (1) according to claim 1, wherein the nozzle (23) and the filter housing (11) are separate parts.

3. The fuel feed device (1) according to claim 1, wherein a filter element (27) is provided in the nozzle (23).

4. The fuel feed device (1) according to claim 1, wherein the filter (9) furthermore has a filter cap (13);
- wherein the nozzle (23) is arranged between the filter housing (11) and the filter cap (13).

5. The fuel feed device (1) according to claim 1, further having a starting pot (29);
- wherein the starting pot (29) has an opening through which the mixing tube extends into the starting pot (29);
- the starting pot (29) is operable to facilitate starting of the ejector pump (21).

6. The fuel feed device (1) according to claim 5, wherein the ejector pump (21) is a second ejector pump (21), the nozzle (23) is a second nozzle (23), and the mixing tube (25) is a second mixing tube (25), and the fuel feed device(1) further having a first ejector pump (15) having a first nozzle (17) and a first mixing tube (19);
- wherein the first mixing tube (19) is arranged parallel to the base of the fuel tank (3); and
- wherein the starting pot (29) is formed integrally with the first ejector pump (15).

7. The fuel feed device (1) according to claim 5, further having a reservoir pot (5);
- wherein the filter (9) and the ejector pump (21) are arranged in the reservoir pot (5); and wherein the starting pot (29) is formed integrally with the reservoir pot (5).

8. The fuel feed device (1) according to claim 5, wherein the starting pot (29) is formed integrally with the mixing tube (25).

9. A method of producing a fuel feed device (1), the method comprising:

providing a fuel pump (37);

providing a filter (9) with a filter housing (11);

arranging an ejector pump (21) with a nozzle (23) and a mixing tube (25) on the filter (9) such that the mixing tube (25) is aligned perpendicularly to a base of a fuel tank (3);

integrating into the filter housing (11) an inlet line (35) for conducting fuel from the fuel pump (37) to the nozzle (23) of the ejector pump (21); and forming the mixing tube (25) and a connection (43) of the mixing tube (25) for connecting an intake line (31) as one piece with the filter housing (11).

10. A fuel feed device (1) for a fuel tank (3), the fuel feed device (1) comprising:

a filter (9) with a filter housing (11);

a first ejector pump (15) having a first nozzle (17) and a first mixing tube (19);

a second ejector pump (21) with a second nozzle (23) and a second mixing tube (25);

a starting pot (29), the starting pot (29) having an opening through which the second mixing tube extends into the starting pot (29), the starting pot (29) operable to facilitate starting of the second ejector pump (21);

wherein the first mixing tube (19) is arranged parallel to the base of the fuel tank (3);

wherein the second mixing tube (25) is arranged perpendicularly to a base of the fuel tank (3);

wherein the starting pot (29) is formed integrally with the first ejector pump (15); and wherein the second ejector pump (21) is at least partially integrated into the filter housing (11).

* * * * *